United States Patent [19]

Hansson

[11] Patent Number: 4,611,671

[45] Date of Patent: Sep. 16, 1986

[54] VIBRATION INSULATING HANDLE

[75] Inventor: Gunnar C. Hansson, Stockholm, Sweden

[73] Assignee: Atlas Copco Aktiebolag, Nacka, Sweden

[21] Appl. No.: 731,528

[22] Filed: May 7, 1985

[30] Foreign Application Priority Data

May 7, 1984 [SE] Sweden ..... 8402446

[51] Int. Cl.[4] ..... B25G 1/02; F01N 1/20

[52] U.S. Cl. ..... 173/162 H; 74/551.9; 173/168; 173/DIG. 2; 181/230

[58] Field of Search ..... 173/168, 169, 162 H, 173/DIG. 2; 30/277, 296; 181/230; 16/111 R, 116 R, DIG. 12; 74/551.9, 551.2

[56] References Cited

U.S. PATENT DOCUMENTS

| | | | |
|---|---|---|---|
| 2,101,869 | 12/1937 | Noble | 173/162 H |
| 4,161,996 | 7/1979 | Dolejsi | 181/230 |
| 4,371,043 | 2/1983 | Kubokawa | 173/162 H |
| 4,421,181 | 12/1983 | Andersson et al. | 173/162 H |

FOREIGN PATENT DOCUMENTS

| | | | |
|---|---|---|---|
| 2922724 | 12/1979 | Fed. Rep. of Germany | 181/230 |
| 2138348 | 10/1984 | Fed. Rep. of Germany | 173/162 H |
| 315590 | 11/1971 | U.S.S.R. | 173/169 |

*Primary Examiner*—Frank T. Yost
*Assistant Examiner*—Hien H. Phan
*Attorney, Agent, or Firm*—Frishauf & Partners

[57] ABSTRACT

A vibration insulating handle for a pneumatic power tool comprising an inner tube (15) and an outer tube (16) both rigidly but adjustably attached to the tool housing (10). The inner tube (15) forms an air exhaust passage (13) which communicates with a silencer (12) carried on the extreme end of the outer tube (16). The tubes (15, 16) are radially spaced relative to each other leaving an annular heat insulating gap therebetween. A weakened portion (30) on the outer tube (16) is located adjacent the tool housing end of the latter and comprises two axially spaced pairs of peripherally extending slots (27, 28). The weakened portion (30) enables the outer tube (16) to yield elastically in radial directions to bending and shearing vibration forces transmitted to the handle during operation of the tool.

6 Claims, 3 Drawing Figures

VIBRATION INSULATING HANDLE

This invention relates to a vibration insulating handle, primarily intended for a pneumatic power tool.

In particular, the invention concerns a vibration insulating power tool handle comprising an inner tube rigidly attached at its one end to the tool housing and forming an air communication passage, an outer tube rigidly attached at its one end to the tool housing and surrounding in a coaxial relationship said inner tube, said tubes being interconnected at their tool housing opposite ends and being radially spaced from each other over a substantial part of their length. A tool handle of this type is previously described in Swedish Patent Application No. 8304986-6, filed on Sept. 16, 1983.

The main object of the invention is to accomplish a vibration insulating power tool handle of the above type without causing a substantial increase in the manufacturing costs of the handle and without impairing the manoeuverability of the tool.

Other objects and advantages of the invention will be apparent from the following description and claims.

Figure 1:
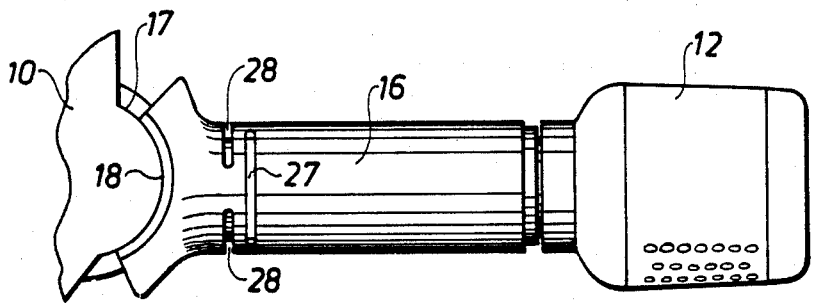
FIG. 1 shows a side view of a handle according to the invention.

The handle illustrated in the drawing figures is attached at one end to the housing 10 of a pneumatic power tool, and carries at its opposite end a silencer 12. The latter communicates with the outlet side of the pneumatic motor of the tool (not shown) via a longitudinal exhaust passage 13 extending through the handle. The exhaust passage 13 is defined by an inner tube 15 which is surrounded by an outer tube 16. At their one ends, to the left in FIGS. 1 and 2, the tubes 15, 16 are rigidly attached to the tool housing 10.

Figure 2:
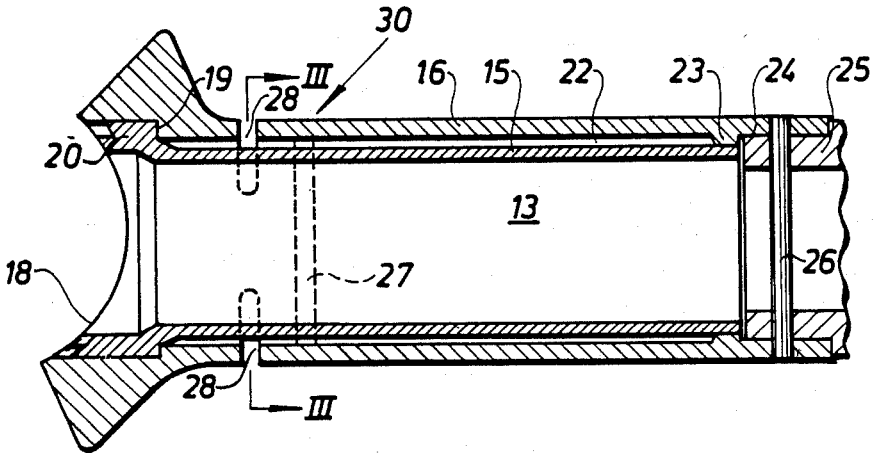
FIG. 2 shows a longitudinal section through the handle in FIG. 1.

For angular adjustment of the handle relative to the tool housing 10 the latter is formed with a part-cylindrical mounting surface 17, see FIG. 1, whereas the handle has a contact surface 18 of the same radius. The handle is locked to the tool housing 10 in desired positions by a clamping means (not shown). The clamping means engages the outer tube 16, and by means of a shoulder 19 in the outer tube 16 and a flange 20 on the inner tube 15 the latter is firmly clamped against the mounting surface 17 on the tool housing 10. Over a substantial part of their length the tubes 15, 16 are radially spaced from each other, thereby forming an annular heat insulating gap 22. Adjacent its tool housing opposite end, the outer tube 16 has an internal waist 23 for radial support of the inner tube 15. The extreme end of the outer tube 16 forms a socket 24 in which a neck portion 25 of the silencer 12 is received. The silencer 12 is locked to the outer tube 16 by means of a transverse pin 26.

Figure 3:
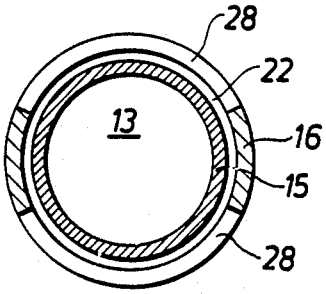
FIG. 3 shows a cross section relating to line III—III in FIG. 2.

Adjacent the tool housing 10, the outer tube 16 is provided with four peripherally extending slots 27, 28. These slots 27, 28 are disposed in pairs in two axially spaced planes, and the slots 27 of one these pairs are located so as to overlap the slots 28 in the other pair. Each of the slots 27, 28 covers more than 90 degrees of the circumference of the tube 16. (See FIG. 3).

The purpose of the slots 27, 28 is to accomplish a weakened portion 30 of the outer tube 16 adjacent the tool housing end of the latter. This weakened portion 30 makes the outer tube 16 yield elastically to bending and shearing vibration forces transmitted to the handle during operation of the tool, which means that a substantial part of the outer tube 16 moves radially relative to the inner tube 15 in response to the vibrations occuring in the latter.

The type of pattern according to which the slots 27, 28 are disposed is advantageous in that the outer tube 16 is rendered weak as regards bending and shearing forces but remains stiff as regards torsional loads. This is important, because handle weakness as regards torsional load would seriously impair the manoeuverability of the tool. It is also important to adapt the characteristics of the slotted weakened portion 30 to the dimensions and material characteristics of the outer tube 16 such that the resonance frequency of the outer tube 16 is lower than the frequency of the vibrations transmitted from the tool housing 20.

In the above described embodiment of the invention the weakened portion 30 is accomplished by two pairs of slots 27, 28 arranged in two axially spaced rows. However, the inventon is not limited to this particular formation, but may be freely varied within the scope of the claims. For example, the slots in each row may be shorter and more than two in number, and there may be more than two rows.

I claim:

1. A vibration insulating handle to be mounted on the housing of a portable power tool, comprising:

an inner tube element rigidly attached at one end to a part of the tool housing;

a grip tube element coaxially surrounding said inner tube element and defining together with said inner tube element an annular gap which extends over a substantial part of the axial lengths of said inner and said grip tube elements;

said grip tube element being rigidly attached to a part of the tool housing at one end and being rigidly connected to said inner tube element at an opposite free end, said grip tube element being provided with a number of circumferentially extending through slots in the vicinity of its one end attached to the housing;

wherein said through slots form a weakened portion of said grip tube element to enable elastic yield of said grip tube element in the radial direction relative to said inner tube element in response to bending and shearing vibration forces transmitted from the tool housing, said weakened portion maintaining resistance to torsional loads applied to said grip tube element during operation of the power tool to avoid impairment of handling of the tool.

2. Handle according to claim 1, wherein said slots are arranged in at least two parallel axially spaced rows, such that portions of the slots in one row are circumferentially coextensive with the slots in the next row.

3. Handle according to claim 2, wherein said inner tube element forms an air communication passage for a pneumatically powered tool.

4. Handle according to claim 3, including a silencer mounted at the free end of said grip tube element and wherein said air communication passage is an exhaust passage for communicating with said silencer.

5. Handle according to claim 1, wherein said inner tube element forms an air communication passage for a pneumatically powered tool.

6. Handle according to claim 5, including a silencer mounted at the free end of said grip tube element and wherein said air communication passage is an exhaust passage for communicating with said silencer.

* * * * *